US009926896B2

(12) United States Patent
Nakashima et al.

(10) Patent No.: US 9,926,896 B2
(45) Date of Patent: Mar. 27, 2018

(54) VEHICULAR SUCTION NOISE TRANSMISSION SYSTEM

(71) Applicant: HONDA MOTOR CO., LTD., Tokyo (JP)

(72) Inventors: Hiroaki Nakashima, Wako (JP); Takahiro Shinkai, Wako (JP); Takashi Kakinuma, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 191 days.

(21) Appl. No.: 15/064,599

(22) Filed: Mar. 9, 2016

(65) Prior Publication Data

US 2016/0265479 A1 Sep. 15, 2016

(30) Foreign Application Priority Data

Mar. 13, 2015 (JP) ..... 2015-050953

(51) Int. Cl.
*F01N 1/02* (2006.01)
*F02M 35/12* (2006.01)
*G10K 11/22* (2006.01)

(52) U.S. Cl.
CPC ..... *F02M 35/1294* (2013.01); *G10K 11/22* (2013.01)

(58) Field of Classification Search
CPC .. F02M 35/1294; F02M 35/108; F02M 25/08; F02B 31/08
USPC ..... 123/184.53, 184.57, 184.52, 302, 308, 123/516, 518
See application file for complete search history.

(56) References Cited

U.S. PATENT DOCUMENTS 7,353,791 B2 * 4/2008 Sasaki ..... F02M 35/10019 123/184.53
7,464,788 B2 * 12/2008 Alex ..... G10K 11/22 123/184.53
7,487,857 B2 * 2/2009 Wolf ..... G10K 11/22 181/229
7,506,626 B2 * 3/2009 Sasaki ..... F02M 35/1294 123/184.53

(Continued)

FOREIGN PATENT DOCUMENTS

JP 4993755 B2 10/2009
JP 2014-185602 10/2014

*Primary Examiner* — Hai Huynh
*Assistant Examiner* — Gonzalo Laguarda
(74) *Attorney, Agent, or Firm* — Mori & Ward, LLP

(57) ABSTRACT

A vehicular suction noise transmission system includes a first intake apparatus, a second intake apparatus, a fuel recirculation apparatus, and a suction noise transmission apparatus. The first intake apparatus is connected to an internal combustion engine mounted in a vehicular engine compartment. The second intake apparatus is connected to the internal combustion engine. The suction noise transmission apparatus includes a first suction noise transmission end, a second suction noise transmission end, and a vibrating body. The first suction noise transmission end is connected to the second intake apparatus. The second suction noise transmission end is in communication with a vehicle interior. The vibrating body is provided to separate a second intake apparatus side and a vehicle interior side and configured to vibrate according to an intake pulsation so as to transmit a suction noise of the internal combustion engine to the vehicle interior.

12 Claims, 4 Drawing Sheets

(56) References Cited

U.S. PATENT DOCUMENTS

| | | | | |
|---|---|---|---|---|
| 7,975,802 | B2 * | 7/2011 | Yokoya | F02M 35/10295 123/184.57 |
| 8,322,486 | B2 * | 12/2012 | Ohta | F02M 35/1294 123/184.57 |
| 2006/0060419 | A1 * | 3/2006 | Alex | F02M 35/10019 181/250 |
| 2013/0269661 | A1 * | 10/2013 | Senda | F02M 25/0836 123/520 |
| 2017/0107921 | A1 * | 4/2017 | Seldon | F02D 33/02 |

* cited by examiner

VEHICULAR SUCTION NOISE TRANSMISSION SYSTEM

CROSS-REFERENCE TO RELATED APPLICATIONS

The present application claims priority under 35 U.S.C. § 119 to Japanese Patent Application No. 2015-050953, filed Mar. 13, 2015, entitled "Vehicular Suction Noise Transmission Device." The contents of this application are incorporated herein by reference in their entirety.

BACKGROUND

1. Field

The present disclosure relates to a vehicular suction noise transmission system.

2. Description of the Related Art

A suction noise transmission device that transmits sound waves (hereinafter, referred to as a "suction noise") that is generated by intake pulsations of an internal combustion engine to a vehicle interior is known (Japanese Patent No. 4993755, for example). The suction noise transmission device described in Japanese Patent No. 4993755 includes an introduction pipe that is connected to an intake passage of the internal combustion engine and that guides the intake pulsation in the intake system, a vibration surface that vibrates due to the intake pulsation, a bellows portion that promotes vibration of the vibration surface, a vibrating body that is provided so as to cover one end of the introduction pipe, and a resonance tube that is connected to the introduction pipe through the vibrating body and that amplifies a sound pressure having a predetermined frequency in the suction sound that is generated by the vibration of the vibrating body. An opening portion of the resonance tube through which the suction noise is released is disposed in the engine compartment at a position where the sound is not insulated so that the suction noise can be easily heard in the vehicle interior.

Furthermore, a suction noise transmission device is also known that is provided with the vibrating body that vibrates due to an intake pulsation at a distal end of an introduction pipe that branches off from an intake pipe and that guides the intake pulsation. In the suction noise transmission device, a transmission pipe that is connected to the introduction pipe and that transmits the suction noise generated by the vibrating body is configured so as to be in communication with a vehicle interior (Japanese Unexamined Patent Application Publication No. 2014-185602, for example). In the above suction noise transmission device, the sound generated by the vibrating body is directly released to the vehicle interior through the transmission pipe; accordingly, the suction noise is effectively transmitted to the inside of the vehicle interior.

SUMMARY

According to one aspect of the present invention, a vehicular suction noise transmission device includes a first intake system, a second intake system, a fuel recirculation system, and a suction noise transmission device. The vehicular suction noise transmission device transmits a suction noise of an internal combustion engine mounted in a vehicular engine compartment to a vehicle interior. The first intake system and the second intake system are connected to the internal combustion engine. A first end of the fuel recirculation system is connected to the internal combustion engine or a fuel tank and a second end of the fuel recirculation system is connected to the first intake system. The suction noise transmission device includes a first end that is connected to the second intake system, a second end that is in communication with the vehicle interior, and a vibrating body that is provided so as to separate a second intake system side and a vehicle interior side from each other and that vibrates due to an intake pulsation.

According to another aspect of the present invention, a vehicular suction noise transmission system includes a first intake apparatus, a second intake apparatus, a fuel recirculation apparatus, and a suction noise transmission apparatus. The first intake apparatus is connected to an internal combustion engine mounted in a vehicular engine compartment. The second intake apparatus is connected to the internal combustion engine. The fuel recirculation apparatus includes a first fuel recirculation end and a second fuel recirculation end. The first fuel recirculation end is connected to the internal combustion engine or a fuel tank. The second fuel recirculation end is connected to the first intake apparatus. The suction noise transmission apparatus includes a first suction noise transmission end, a second suction noise transmission end, and a vibrating body. The first suction noise transmission end is connected to the second intake apparatus. The second suction noise transmission end is in communication with a vehicle interior. The vibrating body is provided to separate a second intake apparatus side and a vehicle interior side and configured to vibrate according to an intake pulsation so as to transmit a suction noise of the internal combustion engine to the vehicle interior.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings.

DESCRIPTION OF THE EMBODIMENTS

Figure 1:
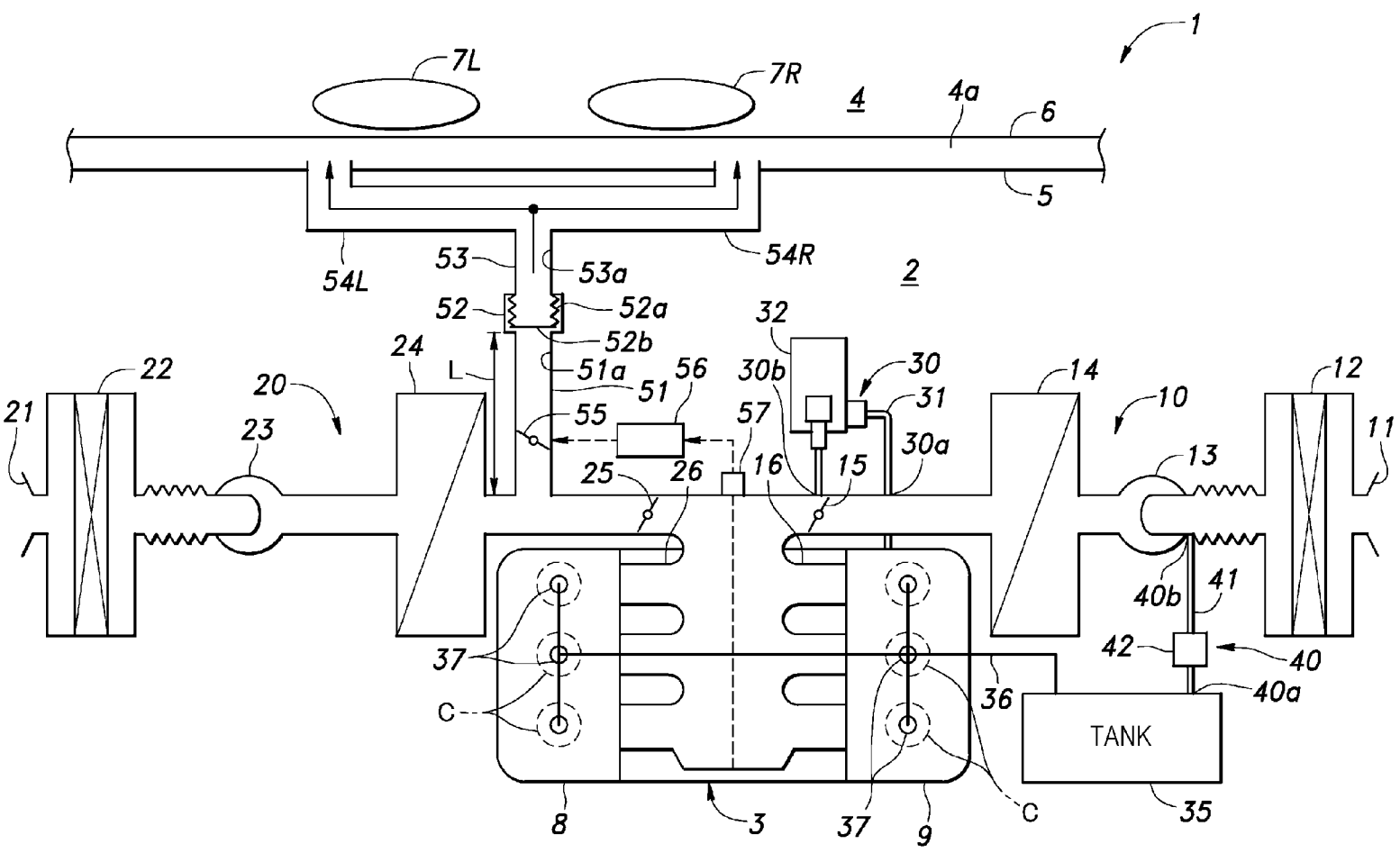
FIG. 1 is a schematic block diagram of a suction noise transmission device according to an exemplary embodiment.

The embodiments will now be described with reference to the accompanying drawings, wherein like reference numerals designate corresponding or identical elements throughout the various drawings.

Hereinafter, an exemplary embodiment of the disclosure will be described in detail with reference to the drawings.

As illustrated in FIG. 1, a suction noise transmission device (a suction noise transmission system) 1 is a device for transmitting a suction noise of an internal combustion engine 3 mounted in an engine compartment 2 of an automobile to a vehicle interior 4 and is mounted in the automobile so as that a large portion thereof is positioned in the engine compartment 2. The engine compartment 2 and the vehicle interior 4 are divided with respect to each other with a vehicle body constituting member 5, such as a bulkhead (a front engine vehicle), or a rear panel or a partition panel (a midship vehicle). Interior members 6, such as a dashboard and a lining material, are attached on the vehicle interior 4 side of the vehicle body constituting member 5. A right seat 7R and a left seat 7L are disposed in the vehicle interior 4.

The internal combustion engine 3 of the present exemplary embodiment is a V6 gasoline engine in which three cylinders C are formed in each of a left bank 8 and a right bank 9. Three intake ports are open on each of the lateral sides of the left and right banks 8 and 9 that are adjacent to each other. A first intake device (a first intake system or a first intake apparatus) 10 is connected to the intake ports of the right bank 9, and a second intake device (a second intake system or a second intake apparatus) 20 is connected to the intake ports of the left bank 8. The first and second intake devices 10 and 20 form successive intake passages that include, in order from the upstream side, intake inlet ports 11 and 21, air cleaners 12 and 22, compressors of superchargers 13 and 23 (turbochargers), intercoolers 14 and 24, throttle valves 15 and 25, and intake manifolds 16 and 26. The intake manifold 16 of the first intake device 10 and the intake manifold 26 of the second intake device 20 are in communication with each other to make the intake pressure uniform and to reduce the intake pulsation.

Although not shown, three exhaust ports are open on each of the lateral sides of the left and right banks 8 and 9 that are opposite each other. A right exhaust device (not shown) is connected to the exhaust ports of the right bank 9, and a left exhaust device (not shown) is connected to the exhaust ports of the left bank 8. The left and right exhaust devices form successive exhaust passages that include, in order from the upstream side, exhaust manifolds, turbines of the superchargers 13 and 23, catalytic converters, mufflers, exhaust outlet ports, and the like. The left and right exhaust devices may share the same components downstream of the turbines of the superchargers 13 and 23 and the catalytic converters.

Furthermore, a blowby gas recirculation device (a blowby gas recirculation apparatus, a fuel recirculation system, a fuel recirculation apparatus, or a breather device) 30, one end 30*a* of which is connected to the internal combustion engine 3 and the other end 30*b* of which is connected to the first intake device 10, is attached to the internal combustion engine 3 in order to recirculate the blowby gas that has been generated inside the crankcase to the exhaust. The blowby gas recirculation device 30 is provided in the cylinder head cover or the like so as to be in communication with the inside of the crankcase and includes a breather chamber that separates engine oil from the blowby gas, a breather passage 31 that connects the breather chamber to a portion in the first intake device 10 downstream of the throttle valve 15, a PCV valve 32 that is provided in-between the breather passage 31, and the like. Furthermore, while not shown, a fresh-air passage for sending fresh air inside the crankcase of the internal combustion engine 3 is connected to the first intake device 10 at a portion between the air cleaner 12 and the supercharger 13.

A fuel tank 35 is installed at an appropriate position (under the seat or the like) in the automobile. The fuel inside the fuel tank 35 is compressed and sent to a fuel pipe 36 with a fuel pump and is supplied to the combustion chambers of the cylinders C with fuel injection valves 37 provided in the internal combustion engine 3. Furthermore, a fuel-evaporative-emission discharge prevention device (a fuel-evaporative-emission discharge prevention apparatus, a fuel recirculation system, or a fuel recirculation apparatus) 40, one end 40*a* of which is connected to the fuel tank 35 and the other end 40*b* of which is connected to the first intake device 10, is attached to the fuel tank 35 in order to prevent evaporative emission inside the fuel tank 35 from being released to the atmosphere. The fuel-evaporative-emission discharge prevention device 40 includes a float valve (not shown) that is provided on the upper portion of the tank, a vent passage 41 that connects the float valve and a portion of the first intake device 10 between the air cleaner 12 and the supercharger 13 to each other, a canister 42 that accommodates activated carbon therein and that is disposed in-between the vent passage 41, a solenoid valve (not shown) for performing purge control, and the like. In the fuel-evaporative-emission discharge prevention device 40, fuel vapor is absorbed with the activated carbon of the canister 42 and the solenoid valve opens the vent passage 41 when the internal combustion engine 3 is in operation to recirculate the fuel vapor to the internal combustion engine 3.

Meanwhile, a suction noise transmission device (a suction noise transmission system or a suction noise transmission apparatus) 50 that transmits the suction noise of the internal combustion engine 3 to the vehicle interior 4 is attached to the second intake device 20. The suction noise transmission device 50 includes an introduction pipe 51, one end 50*a* of which is connected to the second intake device 20 at a portion between the intercooler 24 and the throttle valve 25, that forms an introduction passage 51*a* that introduces the intake pulsation, a vibrating body 52 that is attached to the other end of the introduction pipe 51 and vibrates due to the intake pulsation, and a transmission pipe 53 that is connected to the other end of the introduction pipe 51 through the vibrating body 52 so as to be in communication with the vehicle interior 4 and that forms a transmission passage 53*a* that transmits the suction noise generated by the vibrating body 52 to the vehicle interior 4. In other words, the suction noise transmission device 50 includes the one end 50*a* that is connected to the second intake device 20 and the other end 50*b* that is in communication with the vehicle interior 4. The vibrating body 52 and the suction noise transmission device 50 may be an apparatus sold under the trademark "SOUND CREATOR"®.

In the present exemplary embodiment, the transmission pipe 53 is branched into two extending to the left and right. Left and right branch pipe portions 54L and 54R both reach the vehicle interior 4. More specifically, terminals of the left and right branch pipe portions 54L and 54R are in communication with an intermediate layer 4*a* that is formed in the vehicle interior 4 at a portion between the vehicle body constituting member 5 and the interior members 6. The terminal of the right branch pipe portion 54R is disposed in the vicinity of the right seat 7R (the driver seat, for example) and the terminal of the left branch pipe portion 54L is disposed in the vicinity of the left seat 7L (the front passenger seat, for example).

The vibrating body 52 has a similar structure to that described in Japanese Patent No. 4993755. Specifically, the vibrating body 52 is a resin member including a bellows portion 52*a* and a diaphragm 52*b* provided at the distal end of the bellows portion 52*a* and is provided so as to separate the introduction passage 51*a* formed by the introduction pipe 51 and the transmission passage 53*a* formed by the transmission pipe 53. The vibrating body 52 vibrates by having the diaphragm 52*b* supported by the bellows portion

52*a* receive the intake pulsation introduced into the introduction passage 51*a*, and releases the suction noise to the transmission passage 53*a*. Since the terminal of the transmission pipe 53 (the other end 50*b* of the suction noise transmission device 50) is in communication with the vehicle interior 4, the suction noise is effectively transmitted to the occupant. Note that the transmission pipe 53 may function as a resonance tube that amplifies the pressure in the lower sound range using the natural vibration of the air column.

The introduction pipe 51 has a predetermined length L described later. A control valve 55 that changes a passage area As (an opening degree) of the introduction passage 51*a* and that controls the amplitude (sound pressure) of the intake pulsation transmitted to the vibrating body 52 is provided in the introduction pipe 51 that is near the connection (the one end 50*a* of the suction noise transmission device 50) with the second intake device 20. Furthermore, a valve control unit 56 that controls the opening degree of the control valve 55 is provided in the engine compartment 2. The frequency of the intake pulsation changes according to the engine speed. In the vibrating body 52, since the bellows portion 52*a* functions as a damper and since there is a frequency in which suction noise is easily generated and there is a frequency in which suction noise is not easily generated, the suction noise corresponding to the engine speed is not generated from the vibrating body 52. Accordingly, the valve control unit 56 controls the opening degree of the control valve 55 on the basis of the output (the engine speed) of the crank angle sensor 57 that is provided in the internal combustion engine 3 so as to control the intake pulsation applied to the vibrating body 52 to a predetermined sound pressure. With the above, the sound pressure of the suction noise transmitted to the vehicle interior 4 is made to correspond to the engine speed.

Note that the vibrating body 52 is configured so as not to be damaged under external environments, such as humidity, pressure, pulse, and the like while in use. However, when the vibrating body 52 is used such that the anticipated use environment, service life, distance traveled, and the like, are compromised, the vibrating body 52 may become damaged. When a hole is open in the vibrating body 52, the fuel gas that is to be recirculated to the intake system may disadvantageously flow into the vehicle interior 4.

In the present exemplary embodiment, the blowby gas recirculation device 30 and the fuel-evaporative-emission discharge prevention device 40 are connected to the first intake device 10, and the suction noise transmission device 50 is connected to the second intake device 20; accordingly, the fuel gas that has been recirculated to the first intake device 10 from the blowby gas recirculation device 30 and the fuel-evaporative-emission discharge prevention device 40 is suppressed from flowing into the vehicle interior 4 through the suction noise transmission device 50. Note that while in the present exemplary embodiment, the first and second intake devices 10 and 20 are in communication with each other through the intake manifolds 16 and 26, if the first and second intake devices 10 and 20 are not in communication with each other, no fuel gas will flow into the vehicle interior 4.

Furthermore, since the suction noise transmission device 50 is connected to the second intake device 20 at a portion downstream of the intercooler 24, the air that has increased its temperature by being compressed by the supercharger 23 does not flow into the suction noise transmission device 50 such that deterioration and damage of the vibrating body 52 caused by heat can be suppressed. Accordingly, even if the first and second intake devices 10 and 20 are in communication with each other, the fuel gas that has been recirculated to the first intake device 10 from the blowby gas recirculation device 30 and the fuel-evaporative-emission discharge prevention device 40 is suppressed from flowing into the vehicle interior 4 through the damaged portion of the suction noise transmission device 50 that is connected to the second intake device 20.

Furthermore, since the control valve 55 is provided on the second intake device 20 side with respect to the introduction pipe 51 of the suction noise transmission device 50, in other words, the vibrating body 52, and since, on the second intake device 20 side with respect to the vibrating body 52, the passage area As of the suction noise transmission device 50 is limited by the control valve 55, backflow of the fuel gas to the second intake device 20 is suppressed.

Herein, referring to FIG. 2, conditions in which the air that is inside the first intake device 10 and that includes fuel gas flows back into the second intake device 20 will be discussed. If no superchargers 13 and 23 (FIG. 1) are provided, the inside of the intake passage will always be negative in pressure while the internal combustion engine 3 is in operation. On the other hand, in the present exemplary embodiment, the superchargers 13 and 23 are provided in the first and second intake devices 10 and 20, respectively, and the downstream side of the superchargers 13 and 23 is positive in pressure. The suction noise transmission device 50 is connected on the above downstream side. Accordingly, when a hole, illustrated by a broken line, is open in the vibrating body 52, air may leak from the hole and may disadvantageously flow into the vehicle interior 4 through the transmission pipe 53.

However, when the hole is small, only the air (the white hollow arrow) that includes no fuel gas and that is compressed by the supercharger 23 of the second intake device 20 leaks and all of the air inside the first intake device 10 is drawn into the cylinders C. Whether the air that includes fuel gas (black solid arrows) and that is inside the first intake device 10 backflows towards the second intake device 20 side through the portion communicating the intake manifolds 16 and 26 to each other depends on an opening area A of the damaged portion and the engine speed. Furthermore, when the throttle valves 15 and 25 are throttled, the pressure downstream of the throttle valves 15 and 25 is low with respect to the pressures on the upstream sides; accordingly, the air inside the first intake device 10 is not likely to pass through the throttle valve 25 of the second intake device 20 and backflow. In other words, the larger the opening degrees (passage areas As) of the throttle valves 15 and 25, the likelihood of the backflow of air towards the second intake device 20 side from the first intake device 10 side to occur is increased.

Figure 2:
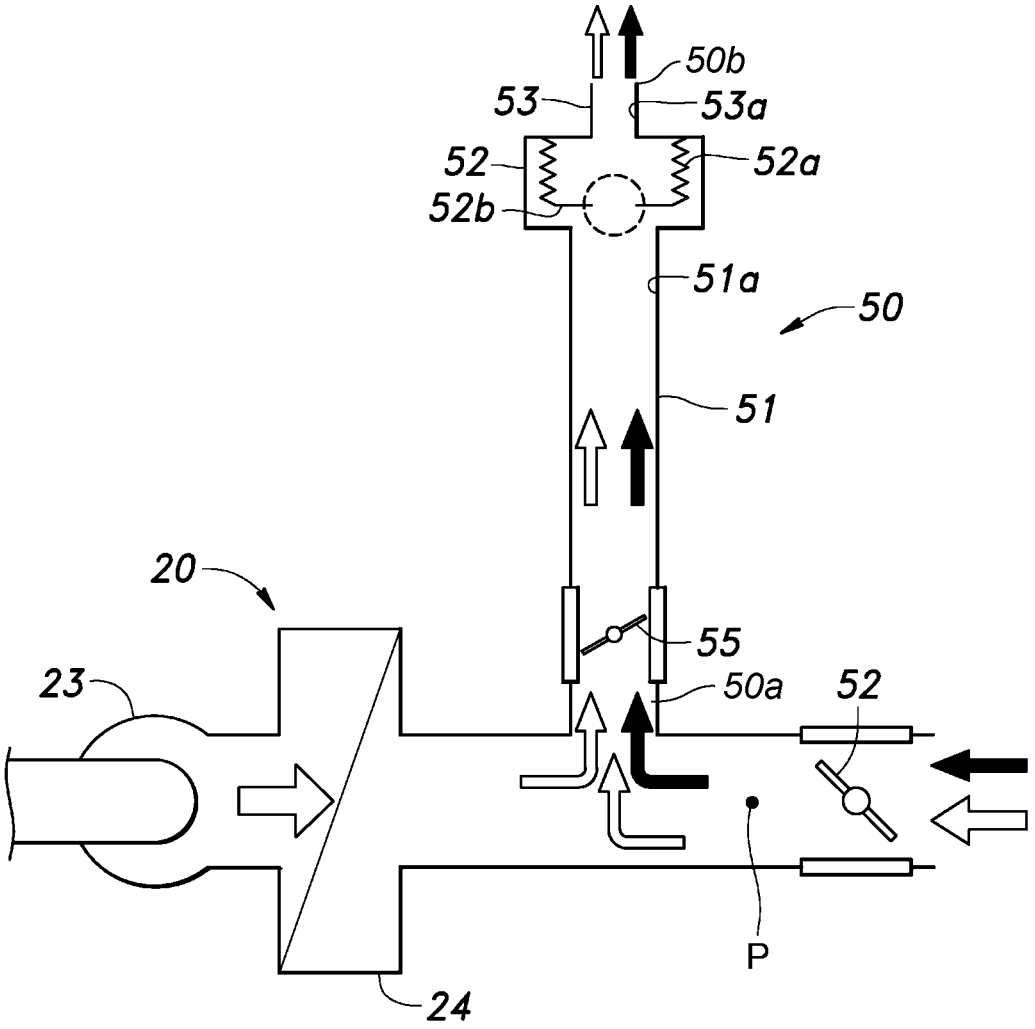
FIG. 2 is an explanatory drawing illustrating a state in which the fuel gas flows into the suction noise transmission device when the vibrating body is damaged.
Figure 3:
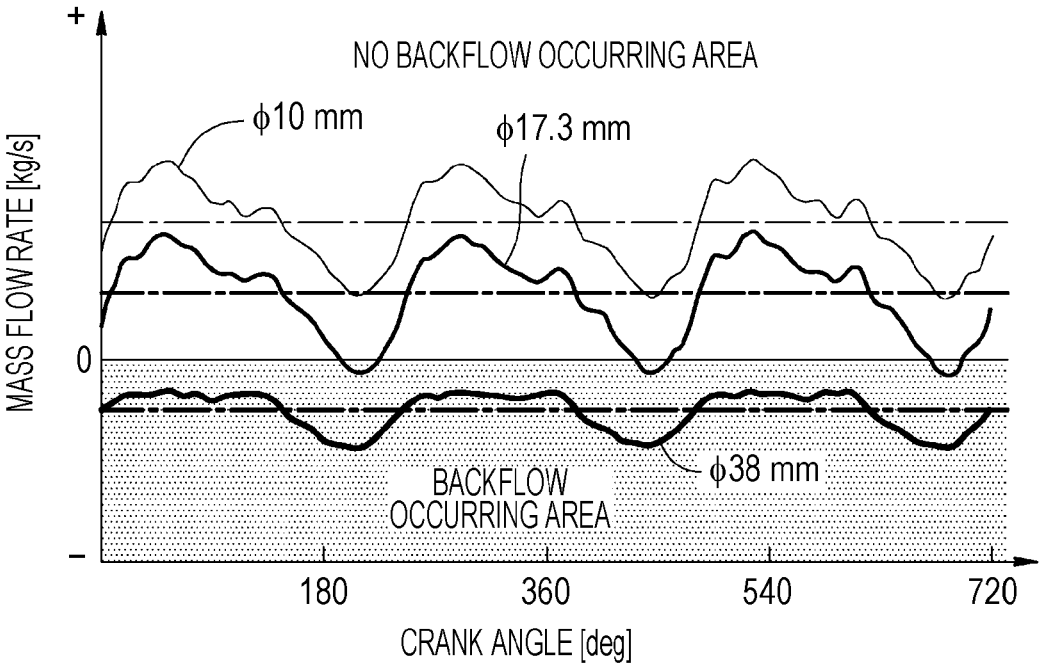
FIG. 3 is a graph illustrating a correlation between a diameter of a hole open in the vibrating body and a mass flow rate of air.

FIG. 3 is a graph illustrating the mass flow rate of the air flowing through a determination point P (a point in the second intake device 20 between the connection with the suction noise transmission device 50, and the throttle valve 25) illustrated in FIG. 2 versus the crank angle under a condition where the throttle valve is fully open (WOT), which is a condition in which the backflow of the air of the first intake device 10 occurs most easily, and in a case in which the engine speed is set to 1500 rpm. The area in which the mass flow rate is positive is an area where the flow of the intake is normal (an area where no backflow occurs), and the area in which the mass flow rate is negative is an area where the flow runs in the opposite direction with respect to the flow direction of the normal intake (an area in which a backflow occurs). Herein, the opening area A of the damage hole is converted into and illustrated as a circular hole having a diameter φ so as to correspond to the opening area A. A case in which the diameter φ of the hole is 10 mm is illustrated with a thin line (a solid line), and a case in which the diameter φ of the hole is 17.3 mm is illustrated with an intermediate line (a solid line), and a case in which the diameter φ of the hole is 38 mm is illustrated with a thick line (a solid line). Furthermore, chain lines each having a thickness corresponding to one of the thicknesses each indicate a mean mass flow rate in the corresponding hole having the corresponding diameter φ. In other words, when the mean mass flow rate is positive, it indicates that, overall, no backflow occurs (except for a momentary backflow during the pulse), and when the mean mass flow rate is negative, it indicates that, overall, a backflow does occur.

Figure 4:
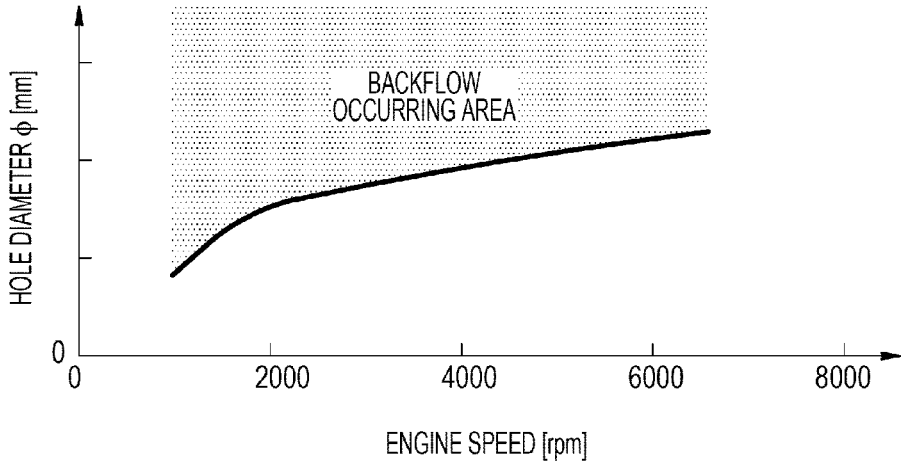
FIG. 4 is a graph illustrating a correlation between engine speed and a diameter of the opening that causes a backflow to occur.

The diameter φ the hole of the damaged portion in which the mean mass flow rate of the air in the determination point P becomes negative is obtained in the above manner. FIG. 4 is a graph indicating the diameter φ of the hole versus the engine speed. As illustrated in the graph, it can be understood that as the engine speed becomes lower, the hole in which the backflow occurs becomes smaller.

Meanwhile, in the present disclosure, the control valve 55 is provided on the second intake device 20 side with respect to the vibrating body 52. If the passage area As of the introduction passage 51*a* is throttled by the control valve 55 and is smaller than the opening area Ab of the damaged portion in which the backflow occurs, for example, even if the vibrating body 52 is dislocated (even if a hole with the largest diameter is open), no backflow of air will occur in the determination point P. Accordingly, in the present exemplary embodiment, the valve control unit 56 controls the opening degree of the control valve 55 to a size in which no backflow of air occurs in the passage area As of the introduction passage 51*a*. With the above, air in the first intake device 10 is prevented from flowing back to the second intake device 20 and no fuel gas reaches the suction noise transmission device 50.

Figure 5:
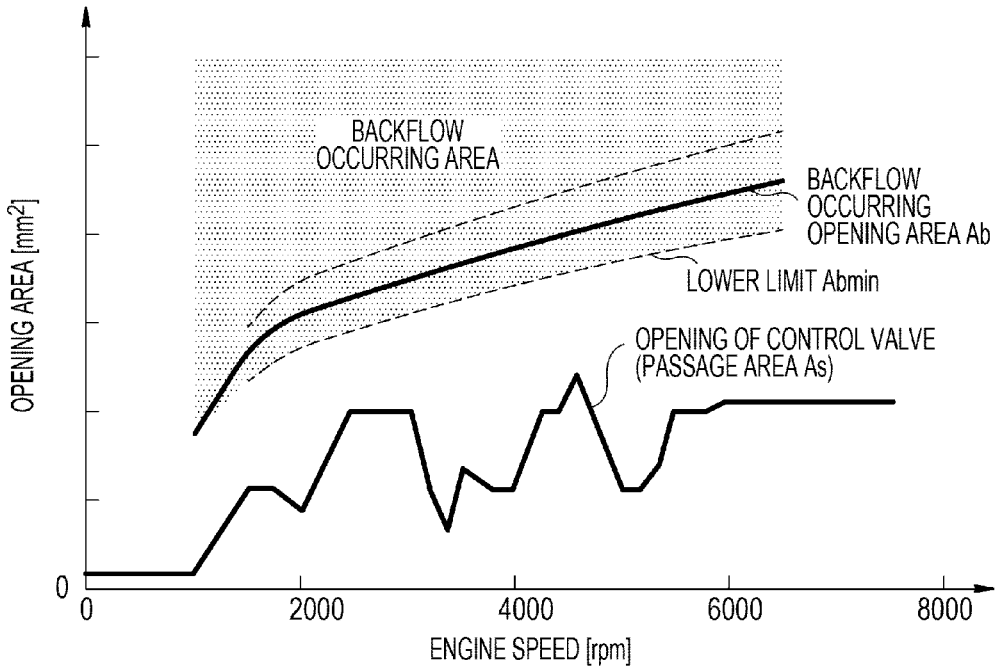
FIG. 5 is a graph illustrating a correlation between engine speed, an opening area that causes a backflow to occur, and a control valve opening area.

FIG. 5 is a graph illustrating the opening degree of the control valve 55 (the passage area As of the introduction passage 51*a*) and the opening area Ab in which the backflow occurs versus the engine speed. However, the opening area Ab in which the backflow may occur may change under conditions other than the condition described above; accordingly, in the present exemplary embodiment, it is deemed that the backflow occurring area is the area above a lower limit Abmin, which provides a predetermined leeway to the opening area Ab, and the opening degree of the control valve 55 is set to an area on or under the lower limit Abmin in which no backflow occurs.

As described above, when there is a damage in the vibrating body 52, by setting the opening degree of the control valve 55 to a value that is smaller than the value that may cause the air from the first intake device 10 to backflow to the suction noise transmission device 50 through the intake manifolds 16 and 26, the fuel gas is prevented from flowing back to the second intake device 20 and no fuel gas will reach the suction noise transmission device 50.

Furthermore, the length L (FIG. 1) of the introduction pipe 51 is set longer than the longest distance the backflow of the air created by a single pulse of the second intake device 20 can reach while flowing back in the introduction pipe 51. Note that the longest distance the backflow can reach is a value determined according to the diameter of the introduction pipe 51. The longest distance the backflow can reach is longer the smaller the diameter of the introduction pipe 51 and is shorter the larger the diameter of the introduction pipe 51. In other words, the distance between the one end 50*a* of the suction noise transmission device 50 to the vibrating body 52 is longer than the longest distance the backflow can reach.

By setting the length L of the introduction pipe 51 in the above manner, incase the fuel gas backflows to the second intake device 20 due to diffusion and the like and reaches the one end 50*a* of the suction noise transmission device 50, the air flowing back due to a single pulse of the second intake device 20 through the suction noise transmission device 50 from the one end 50*a* is prevented from reaching the vibrating body 52. Accordingly, the fuel gas does not flow into the vehicle interior 4 through the suction noise transmission device 50.

While the specific description of the exemplary embodiment is completed, note that a variety of modifications can be implemented without limiting the present disclosure to the exemplary embodiment described above. For example, while in the exemplary embodiment described above, the internal combustion engine 3 is a V-engine having the left and right banks 8 and 9, the internal combustion engine 3 may be an in-line engine. Furthermore, while the first intake device 10 and the second intake device 20 include the intake inlet ports 11 and 21, the air cleaners 12 and 22, the superchargers 13 and 23, and the intercoolers 14 and 24, some or all of the above components may be shared, and the downstream side of the intercoolers or the downstream side of the compressors may be branched into a first intake system (a first intake apparatus) and a second intake system (a second intake apparatus) without providing any superchargers 13 and 23 and intercoolers 14 and 24. Other than the above, as long as the modification does not depart from the scope of the present disclosure, modifications of, for example, specific configurations, the dispositions, the numbers, and the numerical values of the members and portions, may be appropriately made. As regards the components that have been illustrated in the exemplary embodiment described above, all of the components do not necessarily have to be a necessity and may be selected appropriately.

The present application describes a vehicular suction noise transmission device (1) that transmits a suction noise of an internal combustion engine (3) mounted in a vehicular engine compartment (2) to a vehicle interior (4), the vehicular suction noise transmission device including a first intake system (10) and a second intake system (20) that are connected to the internal combustion engine; a fuel recirculation system (30, 40), a first end (30*a*, 40*a*) of which is connected to the internal combustion engine or a fuel tank (35) and a second end (30*b*, 40*b*) of which is connected to the first intake system; and a suction noise transmission device (50) including a first end (50*a*) that is connected to the second intake system, a second end (50*b*) that is in communication with the vehicle interior, and a vibrating body (52) that is provided so as to separate a second intake system side (51*a*) and a vehicle interior side (52*a*) from each other and that vibrates due to an intake pulsation.

According to the above structure, since the fuel recirculation system is connected to the first intake system, and the suction noise transmission device is connected to the second intake system, the fuel gas that has been recirculated to the intake system from the fuel recirculation system is prevented from flowing into the vehicle interior through the suction noise transmission device.

Furthermore, in the above disclosure, preferably, the first and second intake systems (10, 20) each include, in order from an upstream side, a supercharger (13, 23), an intercooler (14, 24), a throttle valve (15, 25), and an intake manifold (16, 26), the first and second intake systems being in communication with each other through the intake manifold of the first intake system and the intake manifold of the second intake system, and, preferably, the first end of the suction noise transmission device is connected between the intercooler (24) and the throttle valve (25) of the second intake system.

According to the above structure, since the suction noise transmission device is connected downstream with respect to the intercooler, the air that has increased its temperature by being compressed by the supercharger does not flow into the suction noise transmission device such that deterioration and damage of the vibrating body caused by heat can be suppressed. With the above, fuel gas that has been recirculated to the first intake system from the fuel recirculation system can be suppressed from flowing into the interior of the vehicle through the damaged suction noise transmission device.

Furthermore, the above disclosure may be provided with a control valve (55) that limits a passage area (As) according to an engine speed, the control valve being provided in the suction noise transmission device and on the second intake system side (51*a*) with respect to the vibrating body.

According to the above structure, since the passage area of the suction noise transmission device is limited by the control valve according to the engine speed at a portion on the second intake system side with respect to the vibrating body, the sound pressure of the suction noise that is transmitted to the vehicle interior can be controlled desirably. Furthermore, even if the vibrating body were to be damaged, the fuel gas can be suppressed from flowing back to the second intake system.

Furthermore, in the disclosure described above, in a case in which the vibrating body is damaged, the opening degree of the control valve is preferably set to a value that is smaller than the value (A) that may cause the air from the first intake system to backflow into the suction noise transmission device through each intake manifold (16, 26).

With the above structure, since the air from the first intake system is prevented from flowing back into the second intake system, the fuel gas does not reach the suction noise transmission device.

Furthermore, in the disclosure described above, in the suction noise transmission device, a distance (L) from the first end of the suction noise transmission device to the vibrating body is preferably longer than a longest distance a backflow created by a single pulse of the second intake system can reach while flowing back in the suction noise transmission device from the first end (50*a*) of the suction noise transmission device.

With the above structure, in case the fuel gas backflows to the second intake system due to diffusion and the like and reaches the first end of the suction noise transmission device, the air flowing back through the suction noise transmission device from the first end upon a single pulse of the second intake system is prevented from reaching the vibrating body. Accordingly, the fuel gas does not flow into the vehicle interior through the suction noise transmission device.

Obviously, numerous modifications and variations of the present invention are possible in light of the above teachings. It is therefore to be understood that within the scope of the appended claims, the invention may be practiced otherwise than as specifically described herein.

What is claimed is:

1. A vehicular suction noise transmission device that transmits a suction noise of an internal combustion engine mounted in a vehicular engine compartment to a vehicle interior, the vehicular suction noise transmission device comprising:

a first intake system and a second intake system that are connected to the internal combustion engine;

a fuel recirculation system, a first end of which is connected to the internal combustion engine or a fuel tank and a second end of which is connected to the first intake system; and a suction noise transmission device including a first end that is connected to the second intake system, a second end that is in communication with the vehicle interior, and a vibrating body that is provided so as to separate a second intake system side and a vehicle interior side from each other and that vibrates due to an intake pulsation.

2. The vehicular suction noise transmission device according to claim 1, wherein the first and second intake systems each include, in order from an upstream side, a supercharger, an intercooler, a throttle valve, and an intake manifold, the first and second intake systems being in communication with each other through the intake manifold of the first intake system and the intake manifold of the second intake system, and the first end of the suction noise transmission device is connected between the intercooler and the throttle valve of the second intake system.

3. The vehicular suction noise transmission device according to claim 2, further comprising a control valve that limits a passage area according to an engine speed, the control valve being provided in the suction noise transmission device and on the second intake system side with respect to the vibrating body.

4. The vehicular suction noise transmission device according to claim 3, wherein in a case in which the vibrating body is damaged, an opening degree of the control valve is set at a value that is smaller than a value that causes a backflow of air from the first intake system to occur in the suction noise transmission device through each intake manifold.

5. The vehicular suction noise transmission device according to claim 4, wherein in the suction noise transmission device, a distance from the first end of the suction noise transmission device to the vibrating body is longer than a longest distance a backflow created by a single pulse of the second intake system can reach while flowing back in the suction noise transmission device from the first end of the suction noise transmission device.

6. A vehicular suction noise transmission system comprising:

a first intake apparatus connected to an internal combustion engine mounted in a vehicular engine compartment;

a second intake apparatus connected to the internal combustion engine;

a fuel recirculation apparatus comprising:

a first fuel recirculation end connected to the internal combustion engine or a fuel tank; and a second fuel recirculation end connected to the first intake apparatus; and a suction noise transmission apparatus comprising:

a first suction noise transmission end connected to the second intake apparatus;

a second suction noise transmission end in communication with a vehicle interior; and a vibrating body provided to separate a second intake apparatus side and a vehicle interior side and configured to vibrate according to an intake pulsation so as to transmit a suction noise of the internal combustion engine to the vehicle interior.

7. The vehicular suction noise transmission system according to claim 6, wherein the first and second intake apparatuses each include, in order from an upstream side, a supercharger, an intercooler, a throttle valve, and an intake manifold, the first and second intake apparatuses being in communication with each other through the intake manifold of the first intake apparatus and the intake manifold of the second intake apparatus, and the first suction noise transmission end is connected between the intercooler and the throttle valve of the second intake apparatus.

8. The vehicular suction noise transmission system according to claim 7, further comprising:

a control valve to limit a passage area according to an engine speed, the control valve being provided in the suction noise transmission apparatus and on the second intake apparatus side with respect to the vibrating body.

9. The vehicular suction noise transmission system according to claim 8, wherein in a case in which the vibrating body is damaged, an opening degree of the control valve is set at a value smaller than a value that causes a backflow of air from the first intake apparatus to occur in the suction noise transmission apparatus through each intake manifold.

10. The vehicular suction noise transmission system according to claim 9, wherein in the suction noise transmission apparatus, a distance from the first suction noise transmission end to the vibrating body is longer than a longest distance a backflow created by a single pulse of the second intake apparatus reaches while flowing back in the suction noise transmission apparatus from the first suction noise transmission end.

11. The vehicular suction noise transmission system according to claim 6, wherein the vibrating body is provided between the first suction noise transmission end and the second suction noise transmission end.

12. The vehicular suction noise transmission system according to claim 6, wherein the fuel recirculation apparatus comprises a blowby gas recirculation apparatus which has a first end connected to the internal combustion engine and has a second end connected to the first intake apparatus in order to recirculate a blowby gas that has been generated inside a crankcase of the internal combustion engine to the first intake apparatus, or the fuel recirculation apparatus comprises a fuel-evaporative-emission discharge prevention apparatus which has a first end connected to the fuel tank and has a second end connected to the first intake apparatus in order to prevent evaporative emission inside the fuel tank from being released to an atmosphere.

* * * * *